US006139343A

United States Patent [19]

Arnett

[11] Patent Number: 6,139,343

[45] **Date of Patent: *Oct. 31, 2000**

[54] SELECTABLE COMPATIBILITY ELECTRICAL CONNECTOR PLUG

[75] Inventor: Jaime Ray Arnett, Fishers, Ind.

[73] Assignee: Lucent Technologies Inc., Murray Hill, N.J.

[ * ] Notice: This patent is subject to a terminal disclaimer.

[21] Appl. No.: 09/236,754

[22] Filed: Jan. 25, 1999

[51] Int. Cl.[7] ..... H01R 29/00

[52] U.S. Cl. ..... 439/188; 439/955; 439/170; 200/51.06

[58] Field of Search ..... 439/188, 955, 439/676, 170; 200/51.03, 51.05, 51.06, 51.09

[56] References Cited

U.S. PATENT DOCUMENTS

| | | | |
|---|---|---|---|
| 4,261,633 | 4/1981 | Abernethy . | |
| 5,041,018 | 8/1991 | Arnett | 439/536 |
| 5,096,439 | 3/1992 | Arnett | 439/536 |
| 5,096,442 | 3/1992 | Arnett | 439/676 |
| 5,186,647 | 2/1993 | Denkmann | 439/395 |
| 5,302,140 | 4/1994 | Arnett | 439/557 |
| 5,346,405 | 9/1994 | Mosser, III et al. | 439/188 |
| 5,647,767 | 7/1997 | Scheer et al. | 439/620 |
| 5,867,576 | 2/1999 | Norden | 439/188 |
| 5,882,217 | 3/1999 | Aponte et al. | 439/188 |

*Primary Examiner*—Lincoln Donovan
*Assistant Examiner*—Hae Moon Hyeon

[57] ABSTRACT

A selectable compatibility plug has a substantially hollow housing member and a plurality of contact members extending from a cable connection end to a connector end. A movable circuit member is contained in the housing for translational movement, the circuit members having circuit components on a surface thereof that is in contact with the contact members. Actuator means for moving the circuit member from a first position to a second position is mounted to the circuit member and adapted to be actuated when the plug is inserted in a low performance jack to cause the contact members to contact certain ones of the circuit elements.

18 Claims, 8 Drawing Sheets

TABLE 10-9
UTP CONNECTING HARDWARE NEXT LOSS

| FREQUENCY (MHz) | CATEGORY 3 (dB) | CATEGORY 4 (dB) | CATEGORY 5 (dB) |
|---|---|---|---|
| 1.0 | 58 | 65 | 65 |
| 4.0 | 46 | 58 | 65 |
| 8.0 | 40 | 52 | 62 |
| 10.0 | 38 | 50 | 60 |
| 16.0 | 34 | 46 | 56 |
| 20.0 | — | 44 | 54 |
| 25.0 | — | — | 52 |
| 31.25 | — | — | 50 |
| 62.5 | — | — | 44 |
| 100.0 | — | — | 40 |

FIG. 3

SELECTABLE COMPATIBILITY ELECTRICAL CONNECTOR PLUG

FIELD OF THE INVENTION

The present invention relates generally to electrical connectors and, more particularly, to a modular connector of the type used in telecommunications equipment.

BACKGROUND OF THE INVENTION

Telecommunication equipment has benefited from the design of electrical plugs and jacks that provide easy connect/disconnect capability between electrical circuits within the telecommunications equipment and, for example, local network wiring. Such plugs and jacks are particularly popular in association with telephone sets, where they were first used, and, more recently, in association with a large variety of peripheral equipment that is connected to telephone lines. The modular plugs and jacks in use today have been standardized, insofar as their performance specifications are concerned and also insofar as certain critical dimensions and structural features are concerned. The use of these devices has become so widespread that new houses and other buildings are prewired with jacks located throughout the various rooms as well as other strategic locations, to accommodate the communication equipment. Where large numbers of such connections are needed, it is typical practice to route the wires to a central location, such as a communication closet where, typically, the jacks are mounted on patch panels. Such an arrangement is shown, for example, in U.S. Pat. No. 5,096,439 of J. R. Arnett. In most installations, it is desirable that the jack be compact, and there have been numerous jacks designed to achieve this goal. In U.S. Pat. No. 5,096,442 of J. R. Arnett there is shown one such compact jack and plug arrangement. The compact electrical connector shown in that patent includes a metallic lead frame mounted to a spring block. The lead frames comprise a number of flat elongated conductors, each terminating in a spring contact at one end and an insulation displacement connector at the other end. The insulation displacement connectors are folded around opposite side walls of the spring block and achieve compactness, and the spring contacts are folded around the front surface of the spring block for insertion into a jack frame. The front surface of the spring block includes a tongue-like projection which fits into one end of the jack frame and interlocks therewith. With the ever increasing numbers of peripheral equipment, and with concomitant increases in operating frequencies, such as required in digital data transmission, connector assemblies such as shown in the aforementioned Arnett '442 patent, while enjoying a large amount of commercial success, do not function well in the higher frequency ranges. The use of such plugs and jacks is impaired by crosstalk within the components, especially in the plug, and as frequencies increase, so does the effect of crosstalk. Numerous arrangements have been proposed for reducing the effects of crosstalk overall by connectors having a minimum of crosstalk, or by connectors which add compensating crosstalk to the overall circuit, such as adding capacitance to the jack to nullify or compensate for the crosstalk in the plug. In U.S. Pat. No. 5,186,647 of W. J. Denkmann et al., there is shown an electrical connector for conducting high frequency signals in which the input and output terminals are interconnected by a pair of metallic lead frames mounted on a dielectric spring block. The lead frames, which are substantially identical to each other each comprises several flat elongated conductors, terminating in spring contacts at one end and insulation displacement connectors at the other end. The conductors are generally parallel and close to each other, but three conductors of one frame are arranged to overlap three conductors of the other frame in a crossover region. As a result, the crosstalk between the several conductors is reduced, due to the reversal in polarities caused by the crossovers.

Nevertheless, for a wide range of applications, an electrical connector having even less crosstalk would be desirable. In particular, the rate of data flow, which is continually being increased in the art today, causes the wiring parts to become, in effect, antennae which both broadcast and receive electromagnetic radiation, thereby, in effect, coupling different pairs of wires together, (crosstalk), thereby degrading the signal-to-noise ratio, and producing an increased error rate. Connectors which, in effect, nullify or at least reduce overall crosstalk, and yet which are usable over wide frequency ranges, are desiderata to which the present invention is addressed. In order for wide frequency usage to be possible, it is desirable that at least some of the components of the connector be compatible with components of connectors in both the low and the high performance categories.

SUMMARY OF THE INVENTION

The present invention, in a preferred embodiment thereof, comprises an electrical connector plug having a high performance loss characteristic for use with a high performance jack of the type shown in the co-pending U.S. patent application Ser. No. 09/236,757 of J. R. Arnett, filed concurrently herewith, but which automatically adjusts, when used in a low performance jack, to be compatible therewith.

In greater detail, the plug has mounted therein a printed wiring board which is movable in longitudinal translation in a pair of guiding slots. On one surface of the wiring board, or PWB, are a plurality of spaced capacitance contact pads, the number being dependent upon the number of leads to which it is desired to add capacitance. The wire leads in the plug which, as in normal practice, wrap around the nose of the plug, have contact portions which bear against the surface of the PWB, and against the capacitance pads of the PWB in a second position thereof, or simply against the non-conducting surface of the board in a first position thereof. The plug further includes a spring member which bears against the end of the PWB remote from the plug nose, and functions to bias the PWB toward the second, non-capacitance engaging position. Actuator means, such as stand-offs from the PWB, function to engage a portion of the jack where the jack is a low performance component when the plug is inserted therein, thus moving the PWB to the capacitance engaging position to introduce capacitance into the circuit for crosstalk compensation and to alter the transmission loss characteristic in the low performance mode. Thus the high performance plug of the invention can be used with a low performance jack.

The plug of the invention is one component of the high performance selectable compatibility connector shown in the co-pending U.S. patent application Ser. No. 09/236,755 of J. R. Arnett, filed concurrently herewith. The jack of that connector has mounted therein a PWB which is movable in longitudinal translation in a pair of guiding slots. As is the case with the plug of the invention, the PWB has on one surface thereof a plurality of closely spaced capacitance contact pads, the number being dependent upon the number of leads to which it is desired to add capacitance. The wire leads in the jack have contact portions which bear against the surface of the PWB and, in a second position, against the capacitance pads thereon, or against a non-conducting portion of the PWB in a first position. The PWB, which as pointed out before, is movable relative to the jack, and more particularly, to the wire leads therein, is biased by a spring member within the jack housing to the first or non-capacitance introducing position which is the desired position for the high performance jack. The PWB has spaced actuator stand-offs mounted thereon which, as will be explained hereinafter, are pushed by the nose portion of a low performance plug to move the PWB to the second position, thereby introducing capacitance into the connector circuit. The jack is provided with first and second spaced slots which receive the stand-offs of the high performance plug of the invention, thereby preventing them from actuating the PWB in the plug. By the same token, the plug has recesses in the sides of the housing thereof which provide clearance for the stand-offs on the PWB of the jack, thereby preventing the high performance plug of the invention from actuating the PWB of the jack.

As a consequence of the clearances as just described, use of the high performance plug of the invention with the high performance jack of the invention results in no additional capacitance being added, but where a low performance plug is used with the jack of the invention, the PWB of the jack is moved to the second, or capacitance adding position. Thus, the plug of the invention and the jack of the invention each adds capacitance when used with a low performance jack or plug, respectively, but, when used together as a high performance connector, neither the plug nor the jack adds capacitance to the connector circuit.

The numerous principles and features of the present invention, as well as the structural details thereof, will be more readily understood from the following detailed description, read in conjunction with the accompanying drawings.

DESCRIPTION OF THE DRAWINGS

FIG. 3 is a table of industry standards for near end crosstalk loss in connecting hardware;

DETAILED DESCRIPTION

Figure 1:
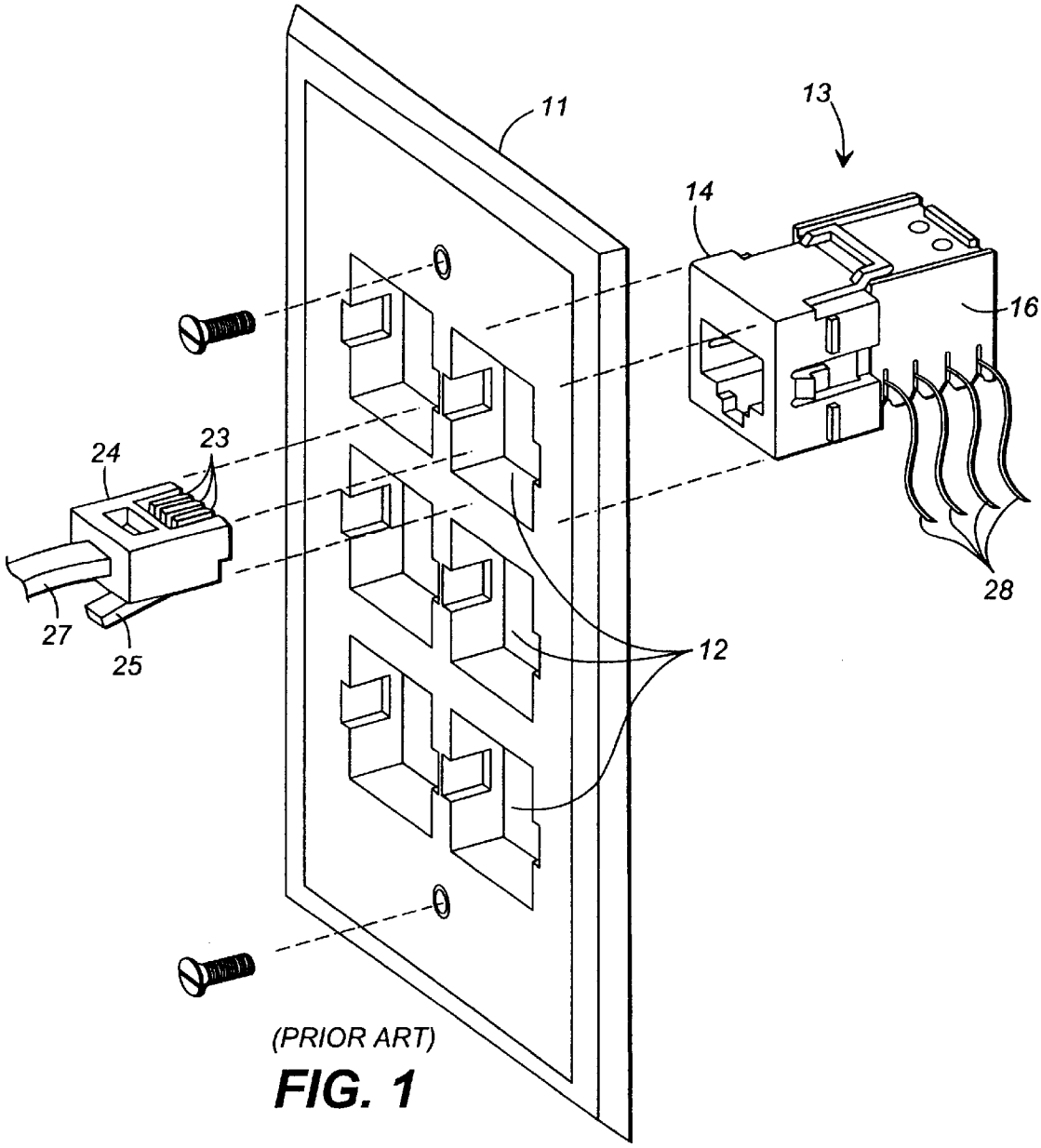
(PRIOR ART) FIG. 1
FIG. 1 is a perspective view of a prior art wall plate with a standard type connector comprising a plug and a jack.
Figure 2:
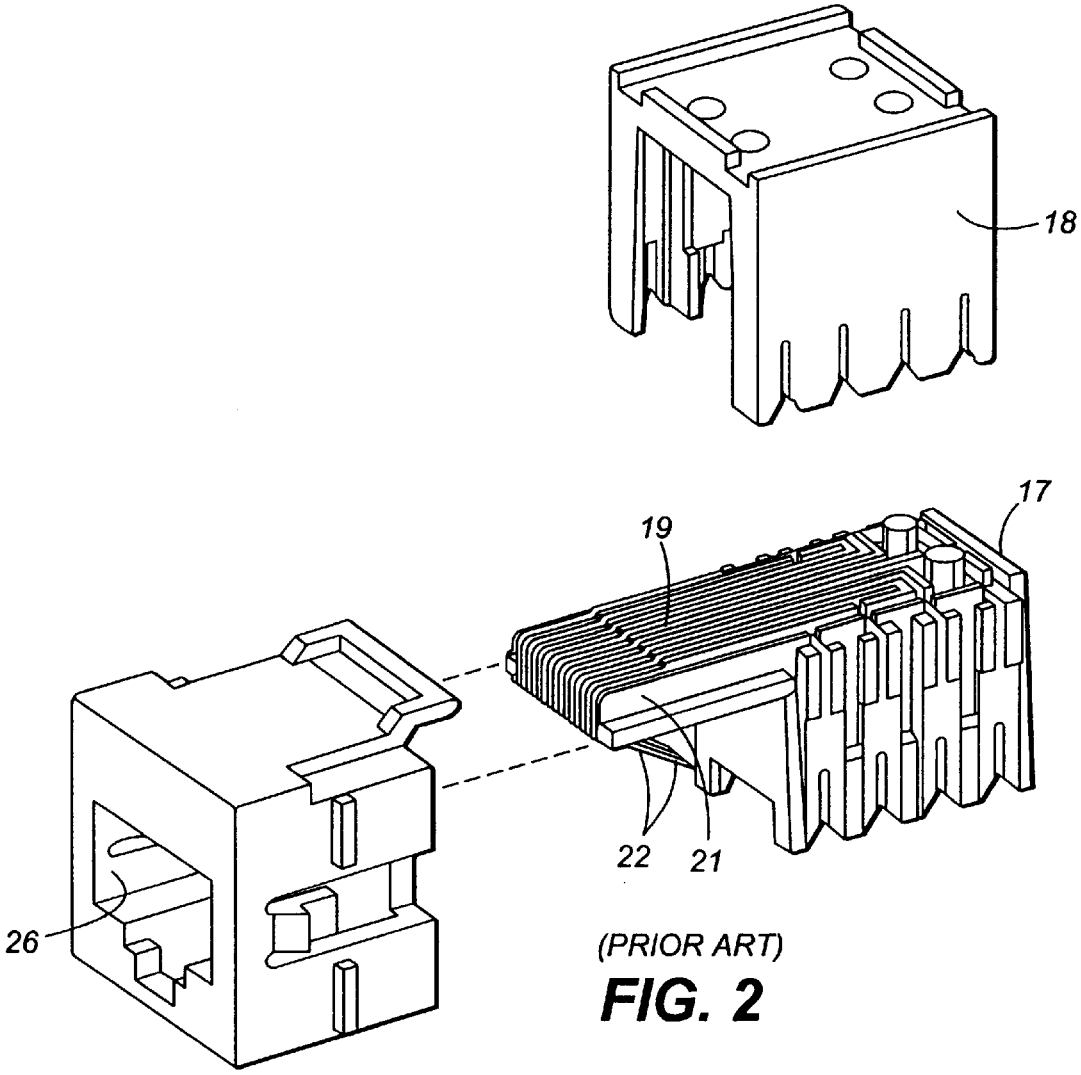
(PRIOR ART) FIG. 2
FIG. 2 is an exploded perspective view of the details of the jack of FIG. 1.

FIG. 1 depicts a prior art wall plate II such as is show in the aforementioned Arnett '442 patent, which has openings 12 therein for receiving up to six modular jacks 13. As shown in the Arnett patent, jack 13 comprises a jack frame 14 and a connector 16 which, together, constitute modular jack 13. As can be seen in FIG. 2, connector 16 comprises a spring block member 17 and a cover member 18. Spring block 17 has a wire frame 19 mounted thereon, the leads of which curve around the nose 21 of the spring block 17 and depend at an angle therefrom to form a plurality of spring contacts 22, which mate with contact members 23 in the plug 24 when it is inserted into the opening 26 of jack frame 14 and locked by means of trigger or latching arm 25. The contact members 23 are each connected to an individual wire in cable 27, and the spring contacts 22 are each connected to an individual wire 28 which may be part of a cable, not shown, or which may lead to individual apparatus, not shown. The plug 24 and the jack 13 may form connections for a number of wires such as, for example, four or eight, depending upon the particular application. Wire frame 19 is shown in FIG. 2 as having eight wires, and, hence, eight spring contacts 22, which plug 24 is shown as having only four contact numbers. It is to be understood that FIG. 2 does not depict a specific connector hook-up, but is intended to illustrate the relationship of the various parts or components of the connector module. The arrangement of FIGS. 1 and 2 has been modified in numerous ways, as pointed out hereinbefore, in efforts to improve the near end crosstalk (NEXT) performance, achieve greater compactness, or to facilitate the operation of connection/disconnection in usage. In all such cases, the actual connect/disconnect operation of the apparatus is basically the same, even where the plugs or jacks have been modified extensively for whatever reason. In other words, the industry standards have to be met.

The present invention is a connector system which is intended to extend the performance range of operation but which complies with industry standards to the extent that the plug and jack of the invention are compatible with existing plugs and jacks, and which, automatically introduce capacitance into the circuitry upon sensing that either the plug or the jack is being used with a pre-existing prior art jack or plug. Thus, the plug and jack of the present invention exhibit "backward compatibility." In FIG. 3, there is shown a table depicting the industry standard allowable NEXT loss requirements at different frequencies and for different performance standard connectors, ANSI/TIA/EIA 568 -A as promulgated by the Telecommunications Industry Association. In the table, the dB values given are, in all cases, negative values, and represent the worst-pair NEXT loss. It can be seen that the allowable loss, at 16 MHz, for a low performance connector (Category 3) is −34 dB, whereas, for a higher performance connector (Category 5) it is −56 dB, a much better performance figure. At the present time, new standards are in the process of being established for even higher categories of connectors, hence the term "high performance" and it is to these connectors that the present invention is primarily directed. "Backward compatibility" is, at present, being explored in the prior art, and proposals exist for achieving it. In a monograph entitled "Connectors With Accessed Quality For Use In D.C., Low Frequency Analogue, And In Digital High Speed Data Applications, IEC 61076 -X-Y, issued by the International Electrotechnical Commission, there are shown several suggested arrangements for achieving compatibility among plugs and jacks. Most of the jacks and plugs therein disclosed rely upon switching, either manually or automatically, between two different wiring schemes, whereas the present invention, as will be apparent hereinafter, relies upon the introduction or removal of capacitance or other current elements from the components or components of the connector system.

Compatible Connector Assembly

Figure 4:
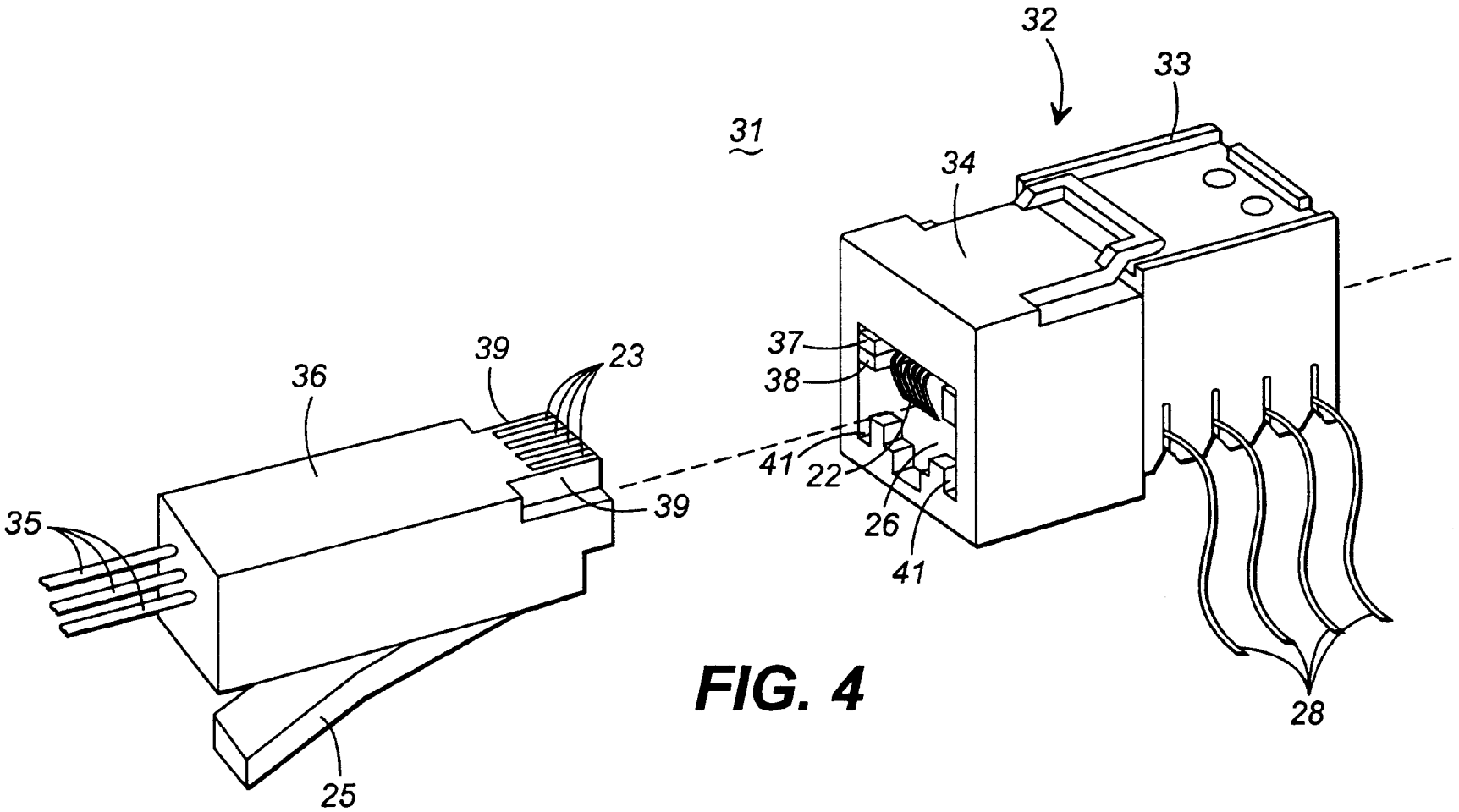
FIG. 4 is a perspective view of a connector assembly which embodies the unique plug and unique jack of the present invention.

In FIG. 4 there is shown the connector assembly 31 of the present invention which comprises a jack 32 having a spring block assembly 33 and a jack frame 34, and a plug 36, connected to leads 35 of a cable or the like for use in high performance e.g. high speed data operation, but automatically adaptable for use in low performance, e.g., low frequency analog operation. Both jack 32 and plug 36 are configured and wired for high performance operation in anticipation of the new parametric standardized requirements, and, as such, exhibit low crosstalk operation. As will be seen more clearly hereinafter, plug 36 has mounted therein a translationally movable printed wiring board (PWB) having a plurality of capacitance contact pads, and actuator means (not shown) which function to engage a portion of a low performance jack to move the capacitance pads into the wiring circuit. Jack 32 also has a translationally movable printed wiring board 37 therein, having actuators or stand-offs 38, which function to engage a portion of a low performance plug when inserted into jack opening 26 to move PWB 37 into position to introduce capacitance into wiring circuit. The PWBs may have more than one surface with circuit components thereon, or may have a layered configuration with circuit components on at least one surface thereof. Plug 36 has first and second recessed portions 39 which are dimensional to allow plug 36 to be inserted into opening 26 without contacting actuators 38, and jack has clearance notches 41 which are dimensional to allow the actuators for the PWB of plug 36 to pass into jack 32 without contacting the front face thereof. Thus, when jack 32 and plug 36 form a high performance (proposed category 6 and above) connection, neither PWB is caused to be moved, hence no additional capacitance is introduced. On the other hand, if jack 32 receives a low performance plug, actuators 38 will be forced toward the rear and, as will be seen hereinafter, capacitance will be introduced. Also, if plug 36 is inserted into a low performance jack, its actuators will move the PWB therein to the capacitance introducing position.

Figure 5:
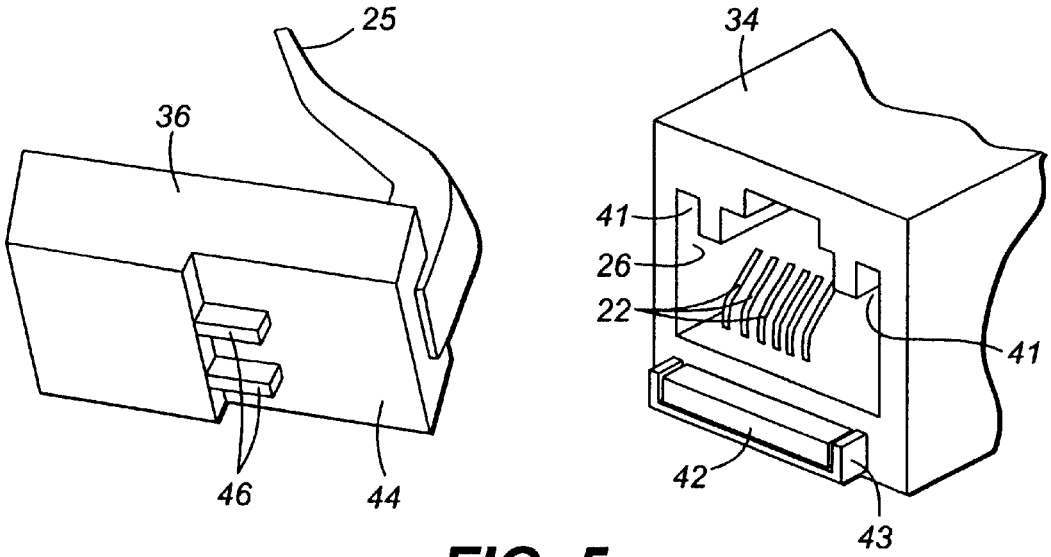
FIG. 5 is a perspective view of an alternative plug and jack arrangement embodying the principles of the invention.

In FIG. 5 there is shown a variation of the connector assembly 31 of FIG. 4. In the arrangement of FIG. 5, the jack member 34 has, as an actuating member for the PWB, a button 42 protected by a protective bracket 43. Button 42 is connected to the spring loaded PWB 37 in jack 34. The high performance plug 36 has, on the bottom surface 44 of plug 36 a pair of button actuators 46. When the button 42 is not depressed, the capacitance on the PWB 37 is engaged, and, when the button 42 is depressed, the PWB 37 is moved out of the capacitance engaging position, and the jack 34 functions as a high performance jack. Plug 36, a high performance plug, when inserted in jack 34 depresses the button 42 by means of actuator 46, and the plug/jack combination functions as a high performance unit. With a low performance plug the button is not depressed and the jack functions as a low performance jack.

Figure 6:
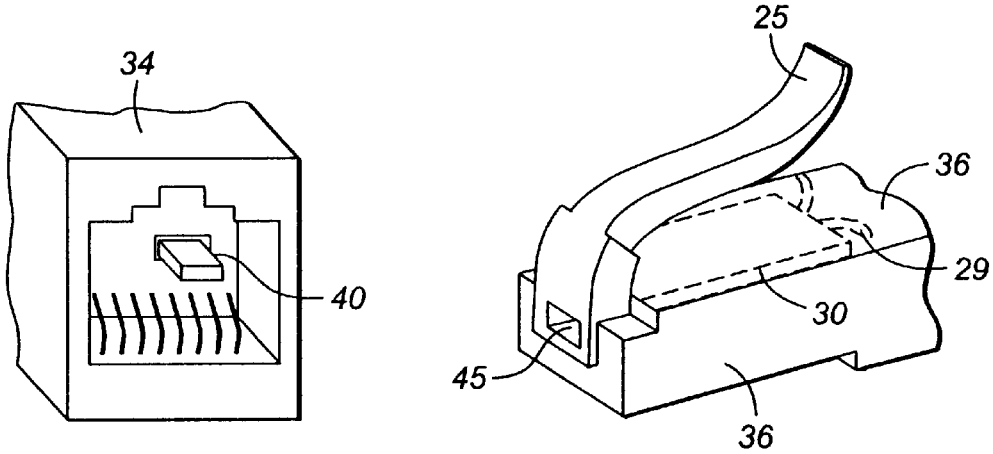
FIG. 6 is a perspective view of another alternative plug and jack arrangement.

FIG. 6 depicts a modification of the connector assembly 31 somewhat similar to that shown in FIG. 5. In the jack 34 is mounted an actuator 40 in the form of a spring loaded plunger, and plug 36 has a plunger opening 45. When plug 36 is inserted into jack 34, the plunger 40 actuates and moves the PWB 30 therein against the force of its biasing spring 29, the spring loading of plunger 40 being stronger than that of spring 29, hence the capacitance is removed from the circuit (as in the arrangement of FIG. 5). In the absence of the plunger, the PWB in the plug is biased to the low performance or capacitance engaging position.

The compatible connector assembly 31 as described herein is the subject matter of U.S. patent application Ser. No. 09/236,755 , filed concurrently herewith.

Plug

Figure 7:
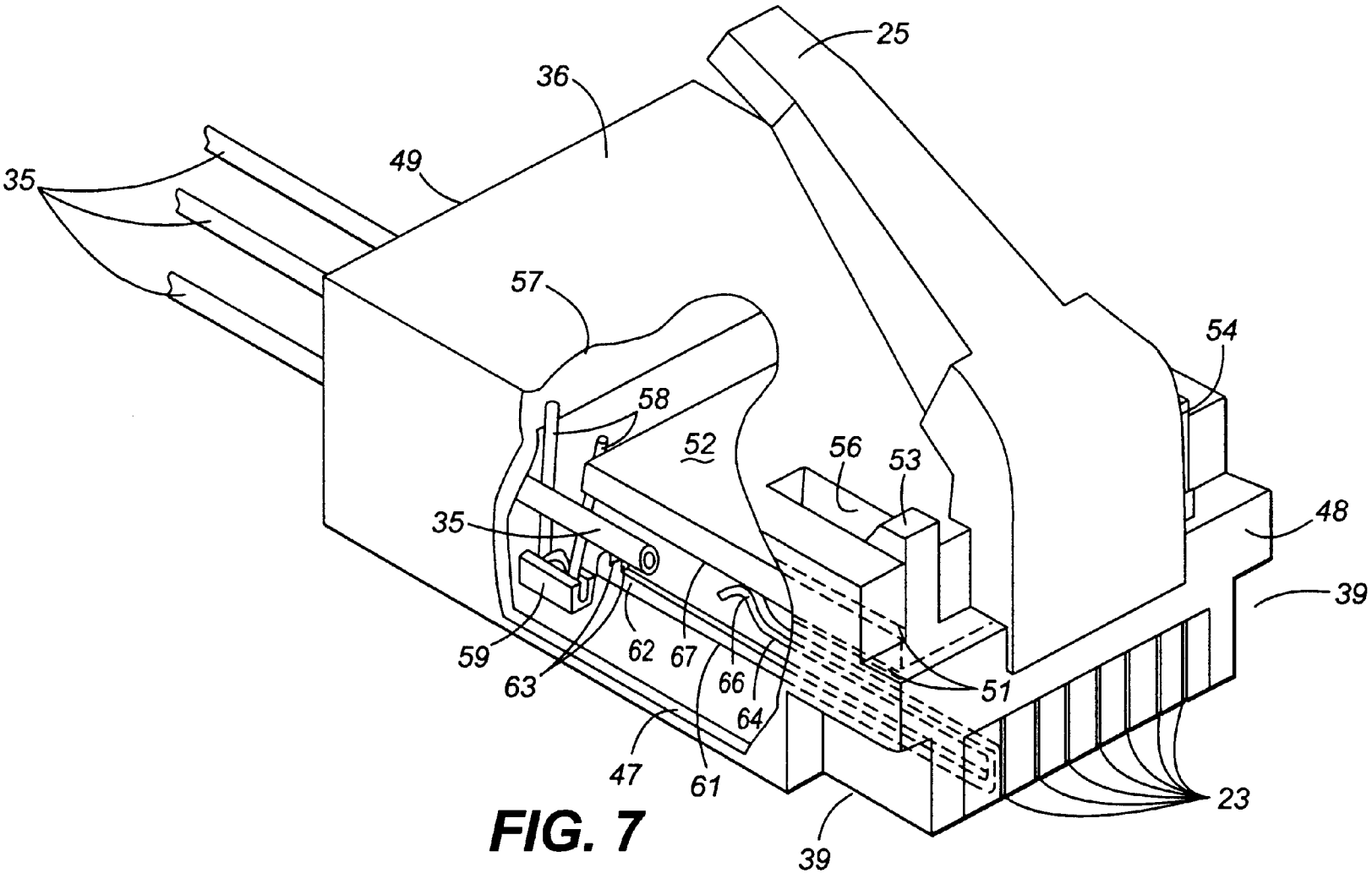
FIG. 7 is a perspective, partially cutaway view of a plug embodying the principles and features of the invention.

In FIG. 7 there is shown a preferred embodiment of the plug 36 of the invention. Plug 36 comprises a substantially hollow body portion 47 having a nose or connector end 48 having a plurality of contact members 23, and a cable connection end 49 shown, for illustrative purposes only, connected to three input wires 35. It is to be understood that wires 35 are representative of a cable, or whatever number, 4, 6, 8, 12, or more of wires to be connected. As previously pointed out, the nose end 48 has first and second recessed portions 39 to allow clearance for the actuators 38 of the jack 32, even when the plug 36 is fully inserted into the jack 32. Mounted within plug body 47, in channels formed by longitudinally extending members 51, is a printed wiring board 52, i.e., PWB, which is slidable in translation within the channels. At the nose end of the PWB and affixed thereto are first and second actuators in the form of stand-offs 53 and 54, which are free to move in translation in slots 56 in the top portion 57 of plug body 47. A spring member 58, shown in FIG. 7 as a safety pin type spring mounted in a suitable mount 59, functions to supply a restoring force to PWB 52, forcing it forward within plug body 47 when actuators 53 and 54 are free to move forward. It is to be understood that spring 58 is merely representative of any of a number of means for supplying a restoring force, such as coil springs, leaf springs, or other resilient members.

The contact members 23 are preferably in the form of blades 61 having a distal end 62 on which are located insulation piercing teeth 63 for making electrical contact with each of the insulated wires 35. At the contact end 23 the blades 61 have a U-shaped configuration, as shown, and a second end 64 having a PWB contacting bend 66. The natural resilience of the blade structure 61 serves to maintain contacting bend 66 in contact with the PWB 52 surface 67 despite any translational movement thereof.

Figure 8:
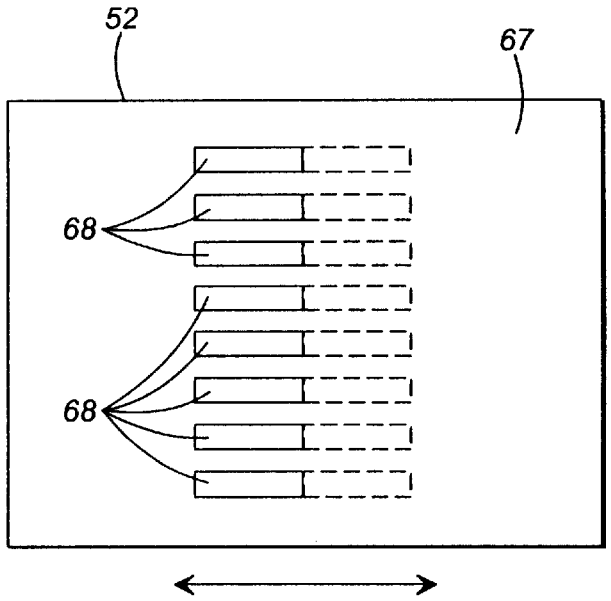
FIG. 8 is a plan view of one printed wiring board arrangement for use in the connector of the present invention.

In FIG. 8 there is shown the PWB 52, and, more particularly, the surface 67 thereof, which has deposited thereon an array of capacitance contact pads 68, preferably gold plated. Pads 68 are shown in a linear array, however, where space is minimal, alternate ones of the pads may be staggered relative to the adjacent pads, or some other configuration of the array may be used, so long as, upon translational movement of PWB 52, as indicated by the arrow, the pads 68 are moved in and out of contact with the contact bends 66. The dashed lines indicate the out of contact position that bends 66 will be in when the PWB 52 is not actuated. While capacitance pads 68 are shown in simple capacitance plates, it is to be understood that the surface 67 may have actual circuitry thereon (not shown) such as, for example, interdigitated capacitors or other circuit components that may be useful in achieving the desired ends, or a capacitance generating metallic structure such as a lead frame arrangement or parallel metal plates without the PWB. In such instances, the lead frame or plates will be movable into and out of the circuit. The basic structure of the plug 36 in a preferred embodiment thereof is shown in FIGS. 7 and 8. It is to be understood that this structure is shown primarily for illustrating the principles and features of the present invention, and numerous modifications and changes may occur to workers in the art without departure from the spirit and scope of the invention.

Figure 9:
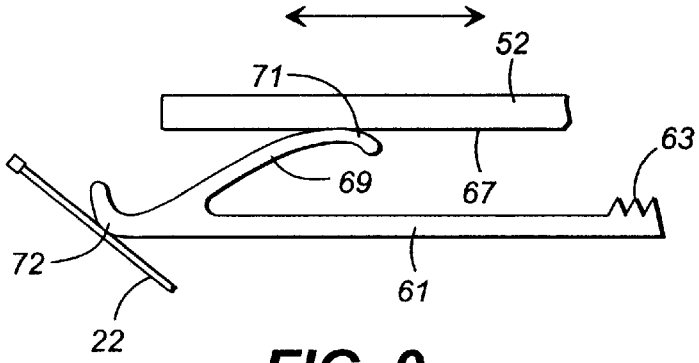
FIG. 9 is a detail diagrammatic view of an alternative contact means for the board of FIG. 8.
Figure 10:
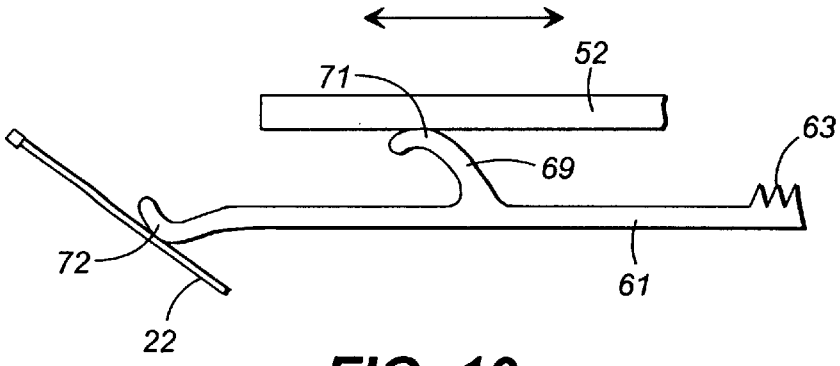
FIG. 10 is a detail diagrammatic view of another alternative contact means for the board of FIG. 8.

In FIG. 9 there is shown, diagrammatically, a modification of a contact member blade 61 for use in the plug 36. For simplicity, like parts bear like reference numerals common to the other views. It an be seen that contact member blade 61 has an extended arm 69 have a curved contact portion or bend 71 which contacts surface 67, and pads 68 on surface 67. The end of blade 61 opposite teeth 63 has a curved contact portion 72 which contacts the wire spring 22 in place of contact members 23 as seen in FIG. 7. FIG. 10 depicts diagrammatically a slightly different configuration for blade member 61 but which functions in the same manner as that of FIG. 9.

From the foregoing, it can be seen that the selectable compatibility plug 36, primarily shown in FIG. 7, automatically adjusts to the kind of jack (low or high performance) with which it is used. Thus, with the advent of higher performance jacks, only one plug design, shown in FIG. 7, is necessary inasmuch as plug 36 of the invention operates satisfactorily with low performance or high performance jacks, with a material cost savings and with no necessity for the installer, for example, to carry a number of different types of plugs.

Jack

Figure 11:
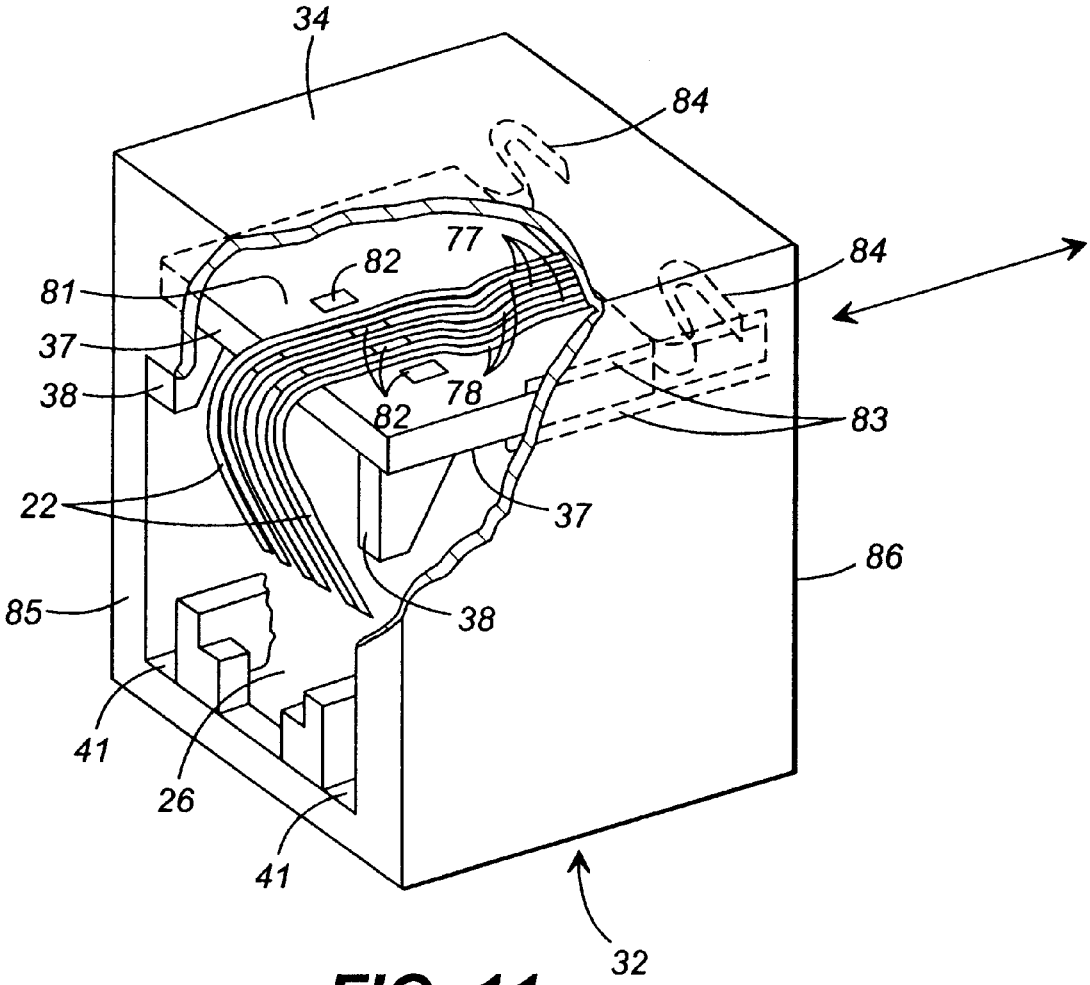
FIG. 11 is a perspective partially cutaway view of a portion of the jack of the present invention.

In FIG. 11 there is shown, in perspective view, a preferred embodiment of the jack 32 of the invention, with only those components which are involved in the structure of the invention being shown, for simplicity. Thus, only jack frame 34 is shown, but it is to be understood that other elements of the jack, which depend, at least in part on the particular use to which it is to be put, are also to be included. Thus, the disclosure of U.S. Pat. No. 5,096,442 of Arnett et al. is incorporated herein by reference, especially for its showing of the basic components of a jack. As shown in FIG. 11, jack frame 34 is substantially the same as jack frame 34 in FIG. 4 and has a front face 85 at the connector end having an opening 26 therein configured to receive a plug. Opening 26 has a pair of clearance notches 41 which provide clearance for the actuators 53 and 54 of plug 36. Jack frame 34 is at least partially hollow, as shown and has a rear portion or face 86. Spring contact members 22, which are mounted within jack frame 34 by any of a number of arrangements known in the prior art, are the contact ends of lead frames, the other ends of which terminate in insulation displacement connectors (not shown). The elongated leads 77 connecting the spring contacts 22 to the insulation displacement connectors have a bend portion 78. Bend portion 78 of each lead contacts surface 81 of PWB 37, and make contact with capacitance pads 82 on surface 81 when the PWB 37 is moved in translation as shown by the arrow. As was pointed out hereinbefore, PWB 37 may have circuitry other than capacitance pads thereof, or other types of mechanism might be used in place of a printed wiring board. Furthermore, in some possible applications, in either or both the plug and the jack, the initial position of the printed wiring board may be a circuitry engaging position, and movement of the board can be such as to remove the circuitry on the printed wiring board out of engagement. Channel forming members 83 on the interior wall of the jack frame 34 form a channel for permitting PWB 37 to more easily in translation, but otherwise maintaining PWB 37 in place within the jack frame 34. First and second restoring springs 84 bear against the rear portion of PWB 37 and against the interior rear wall of jack frame 34. Springs 84 are shown as folded leaf springs, but it is to be understood that any of a number of different means for applying a restoring force might be used, as well as the mounting arrangement therefor. Coil springs, U-shaped springs, safety pin type springs are examples of the types of force members that might be used in place of leaf springs 84. Springs 84 function to return the PWB 37 from its second, or capacitance contacting position to its first, or high performance position when the low performance plug is removed.

In operation, as best seen from the connector assembly 31 of FIG. 4, when a high performance plug such as plug 36 in FIG. 4 is inserted into opening 26 of jack frame 34, recessed portions 39 clear actuator members 38, and PWB 37 is unaffected, i.e., is not moved. On the other hand, when a low performance plug, such as plug 24 in FIG. 1 is inserted in opening 26, it will bear against actuators 38 and, as it is pushed in, PWB 37 is moved in translation, bringing capacitance pads 82, or other circuitry, into contact with leads 77. The resilience of leads 77 is such that the bent portions 78 remain in contact with the top surface 81 of PWB 37 and with capacitance pads 82 when they are moved thereunder. It is to be understood that bends 78 are intended to represent any of a number of possible contacting means, such as contact tabs on each of the leads 77, or framework on the PWB 37 holding the leads 77 in contact with surface 81. When the plug is removed, the springs 84 restore the PWB 37 to its original position.

It is to be understood that, in some circumstances, it will be desired for the capacitance pads to be in contact with the leads in the un-actuated position, to be moved out of such contact when a plug is inserted into the jack.

From the foregoing, it can be seen that the jack of the invention automatically introduces or removes circuitry, e.g., capacitance pads, from the connector circuitry, thus making the jack 32 compatible with either low performance or high performance plugs.

The jack 32, as described herein, is the subject invention of the U.S. Pat. application Ser. No. 09/236,757, filed concurrently herewith.

In conclusion, it should be noted from the detailed description that it will be obvious to those skilled in the art that many variations and modifications may be made to the preferred embodiment without substantial departure from the principles of the present invention. All such variations and modifications are intended to be included herein as being within the scope of the present invention as set forth in the claims. Further, in the claims hereafter, the corresponding structures, materials, acts, and equivalents of all means or step plus function elements are intended to include any structure, material, or acts for performing the functions with other claimed elements as specifically set forth.

What is claimed is:

1. A selectable compatibility electrical connector plug for compatibility with high and low performance connector jacks, said plug comprising:

a housing member, at least a portion thereof being hollow and having a connector end and a cable connection end;

a plurality of contact members extending from said cable connection end to said connector end;

a movable circuit member having a first surface disposed within said housing and having circuit components on said first surface, said movable circuit member being movable in translation between a first position within said housing member and a second position therein; and an actuator for moving said movable circuit member from said first position to said second position.

2. The connector plug as claimed in claim 1 and further comprising a channel within said housing for guiding and supporting said movable circuit member.

3. The connector plug as claimed in claim 1 wherein at least some of said contact members are disposed to be in contact with circuit components on said first surface when the movable circuit member is in the second position.

4. The connector plug as claimed in claim 1 wherein said movable circuit member is a printed wiring board having circuit components on at least one surface or layer.

5. The connector plug as claimed in claim 4 wherein said circuit components are capacitance pads.

6. The connector plug as claimed in claim 5 wherein at least some of said contact members are disposed to be in contact with said capacitance pads when said printed wiring board is in the second position.

7. The connector plug as claimed in claim 1 wherein said actuator is affixed to said movable circuit member.

8. The connector plug as claimed in claim 7 wherein said housing member has a top portion having slots therein forming a clearance passage for said actuator.

9. The connector plug as claimed in claim 8 wherein said actuator projects above said top portion.

10. The connector plug as claimed in claim 1 and further including a restoring force member which bears against one end of said movable circuit member for moving said circuit member in translation from said second position to said first position.

11. The connector plug as claimed in claim 10 wherein said restoring force member is a spring.

12. The connector plug as claimed in claim 1 wherein said contact members are elongated blades, at least one of said blades having a first surface contacting bend.

13. The connector plug as claimed in claim 12 wherein each of said elongated blades is U-shaped, one arm of the U-shape having a distal end, said first surface contacting bend being at said distal end.

14. The connector plug as claimed in claim 13 wherein the other arm of said U-shape has a distal end having insulation piercing teeth for establishing electrical contact with a wire from a cable which said plug terminates.

15. The connector plug as claimed in claim 12 wherein said at least one of said blades has a projecting arm thereon intermediate the ends thereof, said contacting bend being at the distal end of said arm.

16. The connector plug as claimed in claim 1 wherein said housing member has a top portion and first and second sides depending from said top portion, and a bottom portion extending between said sides and forming lower corners therewith; and each of said lower corners having a recess therein.

17. The connector plug as claimed in claim 16 wherein each of said recesses extends from said connector end toward said cable connection end.

18. A selectable compatibility electrical connector plug for compatibility with high and low performance connector jacks said plug comprising.

a housing member, at least a portion thereof being hollow and having a connector end and a cable connection end;

a plurality of elongated electrically conductive contact members extending from said cable connection end to said connector end;

a movable circuit member disposed within said housing and having circuit components thereon movable with said member;

at least some of said contact members including means for contacting said movable circuit members; and means for moving said movable circuit member from a first position within said housing member to a second position therein.

* * * * *